US006247309B1

(12) United States Patent
Haas et al.

(10) Patent No.: US 6,247,309 B1
(45) Date of Patent: Jun. 19, 2001

(54) CYLINDER PISTON UNIT, ESPECIALLY FOR STEAM ENGINES

(75) Inventors: Tobias Haas; Michael Hötger, both of Berlin (DE)

(73) Assignee: TEA GmbH Technologiezentrum Emissionsfreie Antriebe, Berlin (DE)

( * ) Notice: Subject to any disclaimer, the term of this patent is extended or adjusted under 35 U.S.C. 154(b) by 0 days.

(21) Appl. No.: 09/446,018

(22) PCT Filed: Jun. 3, 1998

(86) PCT No.: PCT/DE98/01517

§ 371 Date: Mar. 10, 2000

§ 102(e) Date: Mar. 10, 2000

(87) PCT Pub. No.: WO98/58161

PCT Pub. Date: Dec. 23, 1998

(30) Foreign Application Priority Data

Jun. 18, 1997 (DE) ..... 197 25 646

(51) Int. Cl.[7] ..... F01K 1/00

(52) U.S. Cl. ..... 60/514; 60/515; 60/669; 60/670

(58) Field of Search ..... 60/514, 669, 670, 60/651, 671, 508, 515

(56) References Cited

U.S. PATENT DOCUMENTS 2,867,975 * 1/1959 Mallory ..... 60/514
4,077,214 * 3/1978 Burke, Jr. et al. ..... 60/514 X
4,220,005 9/1980 Cutts .
4,599,859 * 7/1986 Urso ..... 60/514

FOREIGN PATENT DOCUMENTS 818 496 10/1951 (DE) .
828 988 1/1952 (DE) .
43 22 109 1/1995 (DE) .
195 46 658 6/1997 (DE) .

* cited by examiner

*Primary Examiner*—Hoang Nguyen
(74) *Attorney, Agent, or Firm*—Collard & Roe, P.C.

(57) ABSTRACT

The invention relates to a cylinder piston unit, especially for steam engines with expansion by heat influx, which is constructed as follows: a piston guided in the cylinder element has a displacer, a heating device is mounted on the cylinder element for the stroke area of a non-compacting displacer, the working medium is supplied in a vapour or liquid state in the area of the upper dead point, the expanded working medium is discharged at least in the area of the lower dead point. A pore burner is assigned to the cylinder piston unit in an advantageous mamler. To this end, the invention provides for the heat transfer sections (B, C) of a pore burner (50) which surrounds the cylinder head (43) along part of its height to be arranged at the level of the warm section (41) of the cylinder in the stroke area of the displacer (3) and at the level of the cylinder head (43).

11 Claims, 2 Drawing Sheets

CYLINDER PISTON UNIT, ESPECIALLY FOR STEAM ENGINES

The invention relates to a cylinder-piston unit in particular for steam power engines with expansion by heat influx, as defined in the introductory part of the main claim.

Known is a steam power engine with a cylinder-piston unit according to DE-PS 828 988, with expansion by feed of heat. The piston has a warm head, which is insulated against its inner side. The feed of heat to the cylinder-piston element takes place via cylinder ribs by means of an open burner in the stroke area of the insulated warm head and the cylinder head with the compression chamber. The steam is generated directly in the heated cylinder by metered injection of water. The outlet for the expanded steam is formed by slots that are released by the piston in the zone of the lower dead point.

A pore burner for substantially NOx-free combustion is known from patent document DE 43 22 109 A1. Stabilization and limitation of the temperature in the course of combustion is achieved through arranging particles in layers varying based on fine to coarse pores, in steps from the inlet to the outlet of the fuel gas, which assures low-pollutant combustion. This type of burner has a high power density based on its structural volume, whereby the document describes its application as a generator of hot water or of steam.

The invention is based on the problem of feeding the cylinderpiston unit of the steam power engine directly with heat by means of a pore burner admitting heat directly on the cylinder head and expansion chamber.

Said problem is solved by the features specified in the characterizing part of the independent claim and in the dependent claims. By means of the proposed type of construction, a complex feed of heat to the operating medium is achieved for the entire operating space, on the one hand, as well as low-loss heat transfer to said space, on the other.

Pore burners work with relatively low combustion temperatures and, because of their structure, permit the development of heat bridges directly leading to the cylinder-piston unit. The low combustion temperature level is suited for the transfer of heat into the operating process of a steam engine with expansion by heat influx, on the one hand, and assures low-pollutant combustion, on the other.

The features of the dependent claims are explained in greater detail in the description in connection with their effects.

Figure 1:
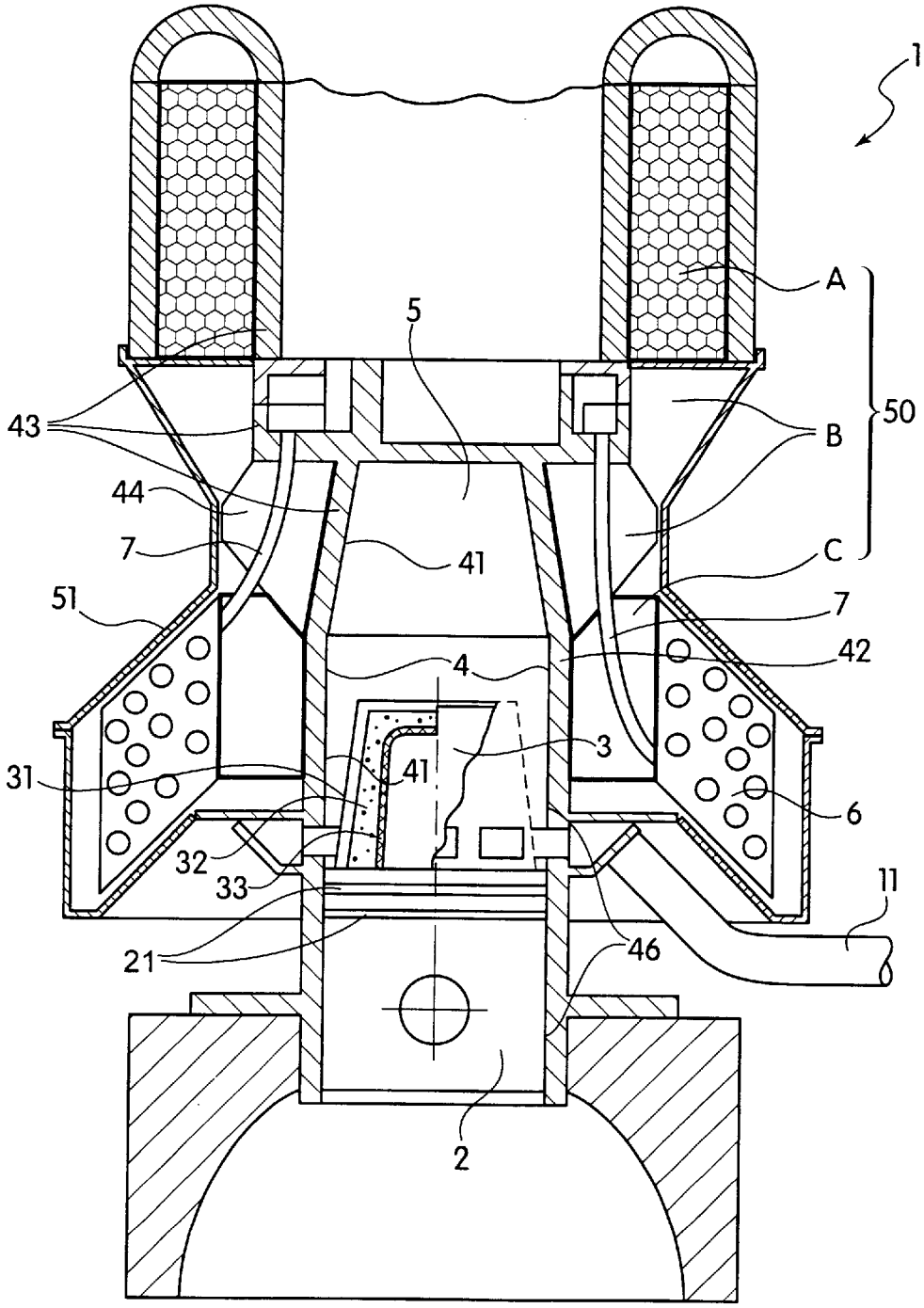
Figure 2:
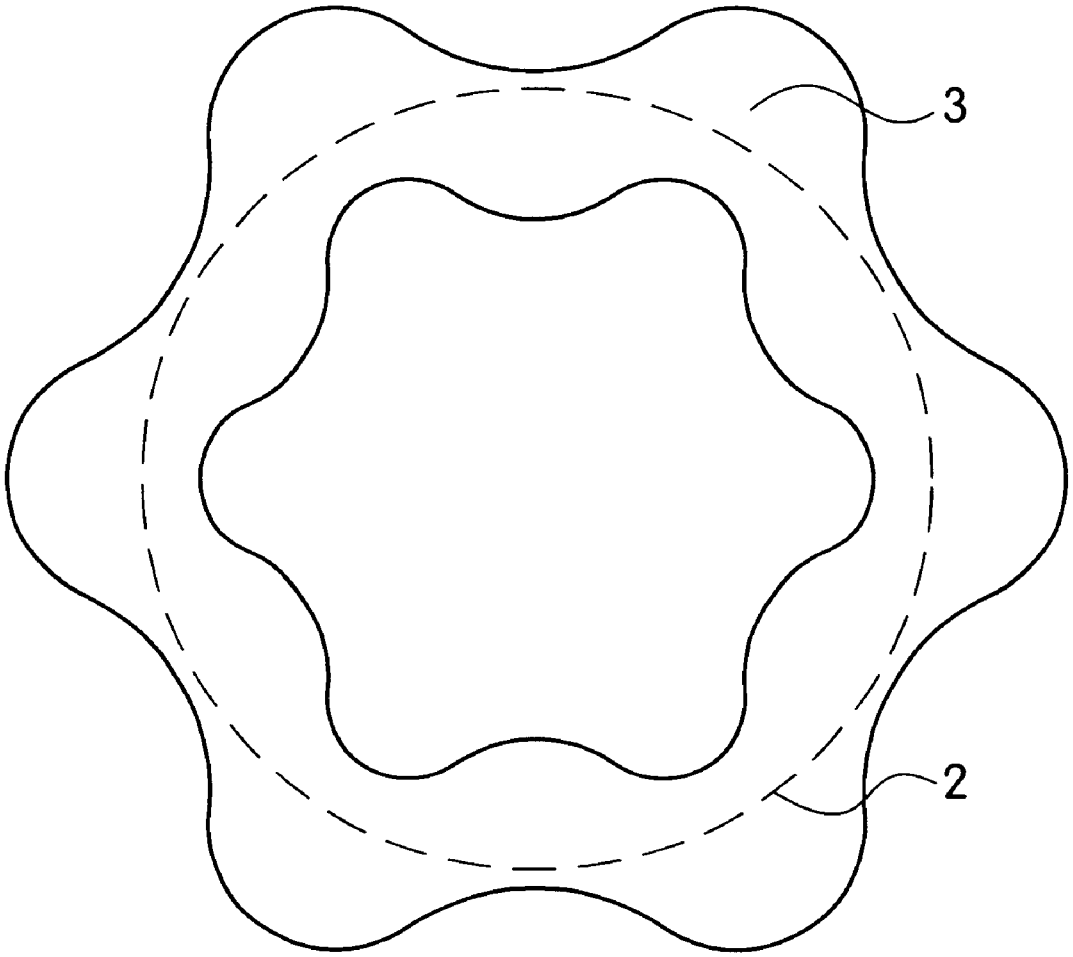

An exemplified embodiment of the invention and further developments of said embodiment according to the dependent claims are described in the following with the help of a drawing, in which:

FIG. 1 is a longitudinal section through a cylinder-piston unit with a displacer, and with feed of heat by a ring-shaped pore burner; and FIG. 2 is a top view of a polygonal displacer, showing a cross section through the cylinder-piston unit with an enlarged surface of the displacer and the warm section of the cylinder, as well as the combustion sections of the pore burner.

FIG. 1 shows a cylinder-piston unit 1 with a piston 2 and a displacer 3, as well as the overall feed of heat to the operating medium in the entire operating space 5. A special pore burner 50 with the combustion section A is employed for this purpose. The heat transfer sections B and C surround the lower part of the cylinder head 43 and the cylinder 1 in the stroke area 41 of the displacer 3. The guide piston 2 supports the sealing rings 21 as well as a displacer 3, which is secured in a heat-insulated manner. Said displacer is connected with a crankshaft (not shown) with a connecting rod, and guided in the cylinder bore 4 in a warm and in a cold cylinder section 41; 46.

The displacer 3 preferably has an absorption or reflection surface 31, and a heat storage layer 32 and an insulation layer 33 are preferably located under said surface. With the design features of displacer 3 described above, storage of heat is achieved, on the one hand, and reflection of heat for heating the charge between the displacer 3 and the inner surface of the cylinder section 41 is accomplished, on the other. Said design ensures corrective transfer of heat with high efficiency by means of the flow within the area of the cylinder, and through hot walls of the cylinder section 41 and the cylinder head 43.

The radial ribs 44 and/or needle- or bridge-shaped, radial attachments are arranged on the cylinder jacket 42 in the cylinder section 41 of the displacer 3, or additionally also on the cylinder head 43, said radial attachments being offset relative to each other. The heat transfer sections B and C of the pore burner 50 are formed between the outwardly closed sectors of said attachments. The cylinder jacket 42 and the cylinder head 43, in their form described above, may be produced in the form of cast or sintered parts, and/or may have a coating for enlarging the heat-transferring surface area.

Within its stroke area, the displacer 3 is guided with play parallel with the warm cylinder section 41 surrounding it, and it has a cross section that becomes smaller in the direction of the cylinder head 43. For optimal transfer of heat to the operating medium, which is present in the operating chamber 5 and in the gap between the warm cylinder section 41, the cylinder head 43 and the displacer 3, the surfaces complementing each other may be designed like a polygon. The hottest heat transfer section B is associated with said area.

In connection with the cylinder bore 4, which is heated from the outside, the warm cylinder section 41 in the stroke area of the displacer 3, and the cylinder head 43 are advantageously designed as radiators, the radiation of which is in the range of the absorption spectrum of the operating medium.

The pore burner 50 is associated with the cylinder head 43. The pore burner extends in the form of a ring, covering part of the cylinder head 43.

The heat transfer sections B and C of the pore burner 50, and the steam generator 6 are usefully surrounded on the outside by an insulating layer 51.

The outer side of the heat transfer sections C on the cylinder jacket 42 is enclosed by a steam generator 6, or preheater. The combustion gases of the pore burner 50 are discharged from the space surrounding the heat generator 6.

Advantageously, the pipe ducts 7 of a superheating stage are arranged between the heat transfer sections B and C and/or in the cylinder jacket 42, preferably in the radial ribs 44 of the latter, said ribs extending parallel with the axis of the cylinder jacket 42.

In the cold cylinder section 46 at the end of the stroke area of the guide piston 2, the outlet duct 11 discharges with windows that are covered by the sealing rings 21 of the guide piston 2.

List of Reference Numerals and Letters:

1 Cylinder-piston unit;
2 Guide piston;
21 Ring seals
1 Displacer

31 Absorption or reflection surface;
32 Heat storage layer;
33 Insulating layer;
4 Cylinder bore;
41 Warm cylinder section/stroke area of displacer 3;
42 Cylinder jacket;
43 Cylinder head;
44 Ribs;
46 Cold cylinder section/stroke area of guide piston 2
5 Operating chamber;
50 Pore burner;
51 Insulating layer;
5 Steam generator;
6 Pipe ducts of a superheater hood;
11 Outlet duct;
A Combustion section of 50;
B Heat transfer section;
C Heat Transfer section.

What is claimed is:

1. A cylinder-piston unit for steam engines with expansion by heat influx comprising:

a piston guided in a cylinder element, said cylinder element comprising a cylinder head (43) and a cylinder jacket (42);

a non-compressing displacer disposed in said cylinder jacket (42);

a heating device arranged on the cylinder element for a stroke area of said non-compressing displacer;

a pore burner (50) disposed on said cylinder head (43); and heat transfer sections (B;C) surrounding said cylinder head (43) over part of its height and arranged on a warm cylinder section (41) in the stroke area of said displacer (3);

wherein operating medium fed in the gaseous or liquid state into a zone of the upper dead point and wherein the expanded operating medium is discharged in an area of the lower dead point.

2. The cylinder-piston unit according to claim 1, wherein said cylinder section (41) comprises at least one of the following: radial ribs (44), needle-shaped radial attachments, and bridge-shaped radial attachments, arranged in the stroke area of the displacer (3), with heat transfer sections (B;C) of said pore burner (50) arranged between sectors of said attachments, said sectors being closed outwardly.

3. The cylinder-piston unit according to claim 1, wherein said cylinder section (41) and said cylinder head (43) are cast or sintered parts.

4. The cylinder-piston unit according to claim 1, wherein said cylinder piston section (41), said cylinder head (43) and said displacer (3) individually or in series have a coating for enlarging the heat transfer surface area.

5. The cylinder-piston unit according claim 1, wherein hot zones and said heat transfer sections (B;C) are outwardly surrounded by an insulating layer (51).

6. The cylinder-piston unit according to claim 1, wherein an outer side of said pore burner (50) surrounding said cylinder head (43) and said cylinder jacket (42), with its heat transfer sections (B;C), is enclosed by a steam generator (6) or a preheater.

7. The cylinder-piston unit according to claim 2, wherein, said heating device comprises a plurality of pipe ducts (7) arranged in or between at least one of the following: said heat transfer sections (B;C) of said pore burner (50) and said radial ribs (44) of said cylinder jacket (42), said radial ribs extending parallel with the axis of said cylinder jacket (42).

8. The cylinder-piston unit according to claim 1, wherein inner sides of said cylinder jacket (42) and said cylinder head (43) are designed as radiators, the radiation of which is in the range of the absorption spectrum of the operating medium.

9. The cylinder-piston unit according claim 1, wherein said displacer is guided with play versus an inner surface of said cylinder element, wherein said inner surface of said displacer (3) is designed as an absorption or a reflection surface for the radiation of said cylinder jacket (42) and said inner surface has a heat storing mass (32) inwardly surrounded by an insulating layer (33).

10. The cylinder-piston unit according to claim 1, wherein said displacer (3), said cylinder jacket (42), said warm cylinder section (41) and said cylinder head (42) are provided with complimentary polygonal structures.

11. The cylinder-piston unit according claim 2, wherein said ribs (44) are incorporated by casting or sintering on said cylinder jacket (42), said ribs being offset relative to one another.

* * * * *